US005415105A

United States Patent [19]

Voss et al.

[11] Patent Number: 5,415,105

[45] Date of Patent: May 16, 1995

[54] TANDEM WARHEAD WITH PIEZOELECTRIC PERCUSSION FUSES

[75] Inventors: Alfred Voss; Wolfgang Poetes, both of Cologne, Germany

[73] Assignee: Dynamit Nobel Aktiengesellschaft, Troisdorf, Germany

[21] Appl. No.: 158,218

[22] Filed: Nov. 29, 1993

[30] Foreign Application Priority Data

Nov. 28, 1992 [DE] Germany ..... 42 40 084.8

[51] Int. Cl.[6] ..... F42C 11/02; F42B 12/18

[52] U.S. Cl. ..... 102/476; 102/210; 102/273; 102/308; 102/499

[58] Field of Search ..... 102/210, 308, 473, 476, 102/478, 499, 273

[56] References Cited

U.S. PATENT DOCUMENTS

| | | | |
|---|---|---|---|
| 2,894,457 | 7/1959 | Severance | 102/210 |
| 3,256,817 | 6/1966 | Rabinow et al. . | |
| 3,438,326 | 4/1969 | Thomanek et al. . | |
| 4,669,386 | 6/1987 | Precoul et al. | 102/476 |
| 5,007,347 | 4/1991 | Greene | 102/473 |
| 5,166,469 | 11/1992 | Kerdraon et al. | 102/210 |
| 5,303,654 | 4/1994 | Held | 102/476 |

FOREIGN PATENT DOCUMENTS

| | | | |
|---|---|---|---|
| 0154580 | 2/1985 | European Pat. Off. . | |
| 0497394 | 1/1992 | European Pat. Off. . | |
| 497394 | 8/1992 | European Pat. Off. | 102/476 |
| 2310547 | 12/1976 | France | 102/476 |
| 2540238 | 1/1983 | France . | |
| 2569834 | 9/1984 | France . | |
| 2535748 | 2/1977 | Germany | 102/210 |
| 3440811 | 11/1984 | Germany . | |
| 3605580 | 6/1987 | Germany | 102/476 |
| 3727652 | 8/1987 | Germany . | |
| 3614883 | 10/1987 | Germany | 102/476 |
| 3942841 | 12/1989 | Germany . | |
| 2216240 | 10/1989 | United Kingdom | 102/476 |

*Primary Examiner*—Harold J. Tudor

*Attorney, Agent, or Firm*—Antonelli, Terry, Stout & Kraus

[57] ABSTRACT

The invention relates to a tandem warhead with a preliminary charge (1) and a main charge (2) respectively each with an associated fuse (3, 4).

So that on ignition two fuses (3, 4) which are completely identical can be used, piezoelectrical percussion fuses (3, 4) are used which can be triggered by shockwaves. To establish the delay period of the fuses (3, 4) the housing construction, the arrangement of the fuses (3, 4) and the material composition of the housing (5) are to be selected in such a way that the propagation time of the shockwave imparts the required delay period.

5 Claims, 1 Drawing Sheet

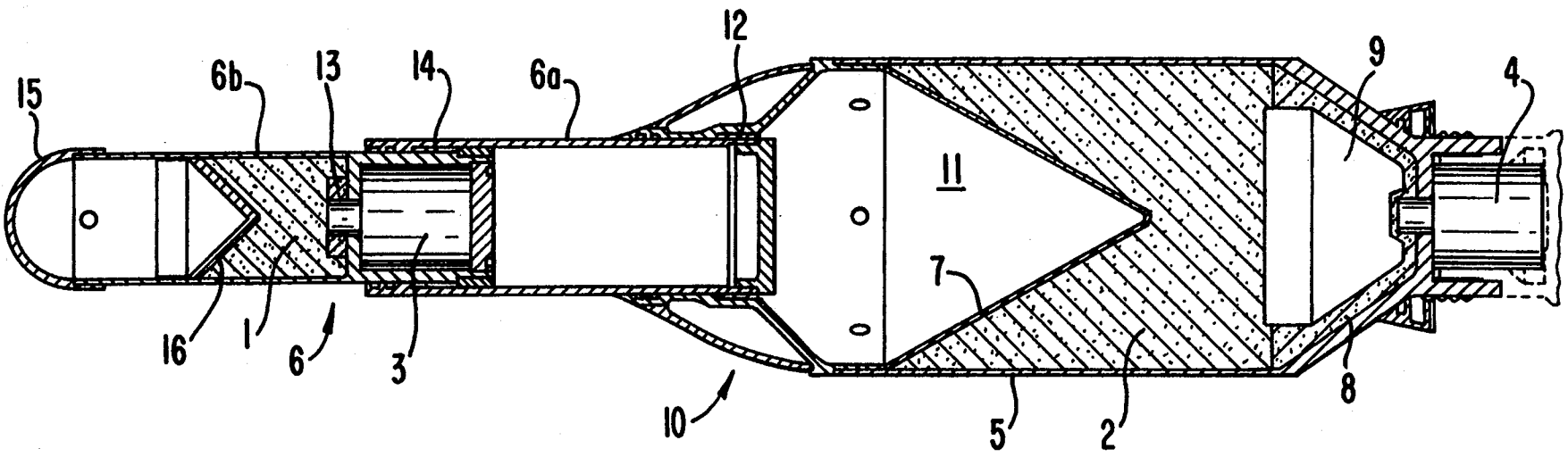
4
9
8
2
5
7
11
12
10
6a
14
3
13
6
1
6b
16
15

TANDEM WARHEAD WITH PIEZOELECTRIC PERCUSSION FUSES

BACKGROUND OF THE INVENTION

The invention relates to a tandem warhead equipped with two identical piezoelectrical percussion fuses, one for the preliminary charge and the other for the main charge wherein the charges and the fuses are spatially arranged in a housing so that detonation of the main charge takes place after a delay period.

Tandem warheads are chiefly used to combat targets, for example tanks, which are provided with so-called ERA-boxes. ERA-boxes are explodable bodies or elements which have the job of exploding when struck by a projectile in order to minimize thereby the effect of the projectile.

A tandem warhead, for example, one launched from an antitank grenade launcher, is known from DE-OS 41 30 646 which consists of a preliminary charge and a main charge coupled with spatial separation. The preliminary charge is ignited before the main charge and effects primary damage to the target struck, so that the temporally delayed main charge is fully effective. The ignition of the main charge takes place without contact by way of the preliminary charge, namely by way of light which is generated by the preliminary charge upon its detonation. For this purpose, a photodiode is arranged in the circuit of the fuse of the main charge, the photodiode responding to the light shortly after the detonation of the preliminary charge.

To achieve maximum damage to the target struck, the main charge must be ignited after an accurately established time after the detonation of the preliminary charge. In DE-OS 41 30 646, this is achieved with a delay part or element which is arranged in the circuit of the fuse of the main charge.

DE-OS 39 42 841 also describes a tandem warhead of the type mentioned above, wherein the main charge has a piezoelectrical percussion fuse. Piezoelectrical percussion fuses essentially contain an electrical transformer (percussion sensor) for generating the ignition voltage and a detonator. The ignition voltage for the detonator arises when, upon striking a target, a shockwave strikes the contact sensor. Piezo-elements are used as sensors. In such devices, the ignition of the main charge does not takes place accordingly without contact.

The manner of functioning of a piezoelectrical contact fuse is described, for example, in German Patent No. 1 145 522 or U.S. Pat. No. 2,894,457.

SUMMARY OF THE INVENTION

The object of the invention is to provide a tandem warhead wherein ignition of the main charge takes place without contact, which warhead is absolutely reliable and which to ignite the charges, has two fuses that are completely identical to each other and that are arranged separately as independent structural components, behind the charges without electrical connections to one another so that the detonation of the main charge takes place after a required delay period.

In accordance with the invention, this object is achieved by providing the tandem warhead with an arrangement wherein the fuse of the preliminary charge also comprises a piezoelectrical percussion fuse, which can be triggered by a shockwave, and by selecting a housing construction as well as the arrangement of the fuses and the material composition of the housing so that the propagation time of the shockwave gives rise to a desired delay in the ignition of the main charge.

Through the use of piezoelectrical percussion fuses both for the preliminary charge and for the main charge, no mechanically moveable parts are used for the ignition. Moreover, two fuses which are completely the same are employed. In this way, the ignition device can be manufactured more securely and also move easily and thus more favorably in terms of cost, since no new official approval method is necessary. Piezoelectrical percussion fuses are distinguished by their high level of reliability. The propagation time of the shockwave until ignition of the main charge, and thus the desired delay is to be established by the construction of the housing, the spatial arrangement of the fuses and the material composition of the housing.

Advantageously, the preliminary charge together with its fuse is arranged in a spacer device which can be moved out of the housing of the tandem warhead in the flight direction, the spacer device consisting of two segments which can be inserted one into the other. As seen in the flight direction, the preliminary charge is arranged in the foremost segment and is spaced from the main charge. The spacer device containing both segments can be inserted into the housing of the warhead.

Both charges, namely preliminary charge and main charge, are, in a preferred embodiment, hollow charges with the tandem warhead preferably being adapted to be launched from an antitank grenade launcher.

Both the fuses are piezoelectrical percussion fuses, as are described, for example, in German Patent No. 1 145 522 or U.S. Pat. No. 2,894,457. Piezoelectrical percussion fuses essentially consist of a percussion sensor which conducts an ignition voltage to a detonator upon the striking of a shockwave. The detonator subsequently causes a primary charge to explode, as a result of which the main charge or secondary charge is ignited. A delay charge can be arranged in the detonator.

Advantageously, the spacer has a front cap which is provided with a pulse attenuator. In this way the ignition occurs less sensitively.

Tests have shown that the first shockwave generated by the striking of the tandem warhead on a target generates in the piezoelectrical percussion fuse at the preliminary charge, or in the piezo-element arranged therein, an electrical voltage of far above 500 V. This voltage is far higher than is required by the detonator of the preliminary charge, with the result that the preliminary charge is always ignited safely and reliably. A little later, the same first shockwave reaches the piezoelectrical percussion fuse of the main charge, If the tandem warhead has struck its target almost at a right angle, then the shockwave is intense enough for the voltage generated in the piezo-element of the fuse belonging to the main charge to be sufficient to ignite the associated detonator. However, if the tandem warhead strikes a target at an acute angle, then the intensity of the shockwave issuing from the impact is often not sufficient to generate in the piezo-element of the fuse of the main charge a voltage adequate for its associated detonator.

In accordance with the invention, this is also not at all a requirement, since shortly after the impact the preliminary charge detonates and this detonation triggers a specific second shockwave which is transmitted in the direction of the fuse of the main charge. This second shockwave is so intense that the voltage generated in the piezo-element of the fuse of the main charge reaches an adequately large value even with extremely small angles of impact of the projectile on a target, with the result that the main charge is always safely ignited.

When firing against ERA-boxes, such boxes were penetrated by the preliminary charge so that the jet from the main charge could flow almost undisturbed through the hole in the box generated by the preliminary charge.

BRIEF DESCRIPTION OF THE DRAWINGS

The invention is described in more detail with reference to the accompanying sole drawing.

The figure shows a tandem warhead with a main charge 2 arranged in a housing 5, the main charge being constructed as a hollow charge and having a copper inlay 7 defining a hollow cavity. For the ignition, a piezoelectrical percussion fuse 4 is arranged at the rear end of the housing 5, which tapers to an end in the shape of a cone. A primary charge 8 and an inert body 9 serving as detonation wave guide are arranged between the fuse 4 and the main charge 2.

As seen in the flight direction, the housing 5 tapers in front of the main charge 2 and forms there an annular opening which is constructed as a spacer guide 10. A spacer device 6 is inserted into this spacer guide 10, the spacer device consisting of an assembly of two segments **6*a*, 6*b*, the segment 6*a* of which is displaceably mounted in the spacer guide 10. The spacer device 6 is dimensioned and positioned in such a way that a hollow charge spike can be formed in the free area or cavity 11 over the inlay 7. The segment 6*a* of the spacer device 6 can be fixed by way of a threaded coupling 12 in an extended state. The segment 6*b*, in which is arranged a preliminary charge 1 with an associated fuse 3 is guided in or inserted within the segment 6*a*. The primary charge for the preliminary charge 1 is indicated by the reference number 13. No detonation wave guide is provided. The segment 6*b* can be inserted into the segment 6*a* of the spacer device 5 and is provided with a threaded coupling 14 for fixing its end facing the segment 6*a*. A hemispherical cap 15 is attached to the segment 6*a* of the spacer device 6 at its head end. So that the ignition does not occur too readily, i.e. with reduced sensitivity, for example when striking trees etc., the cap 15 is advantageously provided with a pulse attenuator, not shown. An inlay 16** is attached to the preliminary charge, as is usual with hollow charges.

Both fuses 3, 4 are piezoelectrical percussion fuses. Since the propagating time of a shockwave greatly depends on distance, the material composition and the construction of the housing 5, these values which influence the delay period must be selected in such a way that the delay period lies within a desired limit. Should a longer delay period be necessary, a delay charge or a delay element can be installed in the detonator of the main charge or the spatial arrangement of the fuses and associated charges can be reconfigured. A delay element is, for example, an electronic element that does not ignite trigger (4) until a certain voltage is reached. However, a delay charge can also be provided in which the shockwave first ignites the delay charge, which in turn ignites the main charge after a time delay.

The housing (5) of the tandem warhead is made from a lightweight metal, for example, a magnesium alloy or an aluminum alloy. The travel time of the shockwave and the delayed ignition of the main charge (2) associated therewith is determined mainly by the composition of the material and the distance between the two triggers (3, 4). Advantageously this distance should be between 300 and 400 mm. This produces a travel time for the shockwave from trigger (3) to trigger (4) of 100 to 150 microseconds. In order for the shockwave to penetrate the trigger and set it off, the trigger must be firmly attached to the housing. The housing also has no soft points that would damp the shockwave, but is made stiff so that the shockwave propagates without being damped.

The sole figure shows an "exploded" view of the warhead, i.e. the segments **(6*a*, 6*b*) are withdrawn from the warhead. Segment 6*a* is displaceably mounted in the spacer guide 10, while segment 6*b* is in turn displaceable in segment 6*a*, both being located in the free space 11 in front of insert 7** in the inserted state.

What is claimed is:

1. A tandem warhead comprising a housing, a preliminary charge located near a front end of the housing, a main charge arranged behind the preliminary charge and spatially separated therefrom within the housing and a fuse for each charge arranged so that the preliminary charge is ignited before the main charge, the fuse for the main charge comprising a piezoelectrical percussion fuse which may be triggered by a shockwave generated by impact of the warhead that travels from the front end to the fuse for the main charge, and the fuse for the preliminary charge also comprising a piezoelectrical percussion fuse which may be triggered by the shockwave generated by impact of the warhead, detonation of the preliminary charge generating a second shockwave which reinforces the first shockwave and, if necessary, insures triggering of the fuse of the main charge; the housing construction and the arrangement of the fuses and the material composition of the housing being selected such that the propagation of the shockwaves imparts a desired delay of ignition of the main charge.

2. A tandem warhead according to claim 1, wherein the preliminary charge together with its associated fuse is arranged in a spacer device which is moveable outwardly of the housing in a flight direction of the warhead.

3. A tandem warhead according to claim 2, wherein the spacer device consists of two segments, one of which is inserted into the other.

4. A tandem warhead according to claim 3, wherein the preliminary charge and the main charge are hollow charges.

5. A tandem warhead according to claim 1, wherein the warhead is launchable from an antitank grenade launcher.

* * * * *